United States Patent [19]

Landis et al.

[11] Patent Number: 4,850,049

[45] Date of Patent: Jul. 25, 1989

[54] COMBINED SURGEON'S CAP, VISOR AND PROTECTIVE SHIELD

[76] Inventors: Timothy J. Landis, 2006 McLaren Dr., Roseville, Calif. 95661-4945; Charles V. Wirth, 1320 A Kobbe Ave., San Francisco, Calif. 94129

[21] Appl. No.: 229,448

[22] Filed: Aug. 8, 1988

[51] Int. Cl.[4] ..... A42B 1/06

[52] U.S. Cl. ..... 2/10; 2/9

[58] Field of Search ..... 2/9, 10, 11, 12, 13, 2/DIG. 11

[56] References Cited

U.S. PATENT DOCUMENTS

| | | | |
|---|---|---|---|
| 2,179,719 | 11/1939 | Goskey | 2/10 |
| 2,629,874 | 3/1953 | La Maida | 2/ |
| 2,638,593 | 5/1953 | Eloranta | 2/12 |
| 2,682,666 | 7/1954 | Mayer | 2/10 X |
| 2,834,017 | 5/1958 | Simpson et al. | 2/10 |
| 2,968,812 | 1/1961 | Vivolo | 2/12 |
| 3,475,766 | 11/1969 | Rashke | 2/10 |
| 3,577,564 | 5/1971 | Hill | 2/10 |
| 3,685,054 | 8/1972 | Raschke | 2/10 |
| 4,258,437 | 3/1981 | Sawatsky | 2/9 |
| 4,317,238 | 3/1982 | Amin | 2/DIG. 11 X |

*Primary Examiner*—Werner H. Schroeder
*Assistant Examiner*—Jeanette E. Chapman
*Attorney, Agent, or Firm*—Julian Caplan

[57] ABSTRACT

To protect a surgeon or operating room personnel from splatter from a patient afflicted with various diseases (including A.I.D.S.) a transparent shield is supported in front of the face hanging down to about the chin. A conventional surgeon's disposable cap is fixed to a visor which projects forward and down from the forehead. The upper edge of the shield is supported by the visor.

8 Claims, 2 Drawing Sheets

COMBINED SURGEON'S CAP, VISOR AND PROTECTIVE SHIELD

CROSS-REFERENCE TO RELATED APPLICATIONS

Reference is made to U.S. Pat. No. 4,701,965 of Landis (one of the co-inventors of the present application) on which the present application is an improvement. Application Ser. No. 194,150 filed 5/16/88 of Landis is also cross-referenced.

BACKGROUND OF THE INVENTION

1. Field of the Invention

This invention relates to a new and improved combined surgeon's cap, visor and protective shield. A particular feature of this invention, as compared with other applications of Landis is that a surgeon's cap of the type conventionally used for sanitary reasons is employed as a support for a visor which projects forward from the forehead of the wearer and supports the upper edge of a transparent shield in such position that it is spaced in front of the face. The shield extends down to a level below the chin and protects the wearer from exposure to blood and other bodily fluids of a patient who may be infected with a germ or virus. It will be understood that where the term "surgeon" is used herein, the term is intended to include operating room personnel. Furthermore, use of the present invention in environments other than operating rooms is likewise contemplated.

2. Description of Related Art

Surgical caps of various types are conventionally used in operating rooms for sanitary reasons. U.S. Pat. No. 4,701,965 shows a protective shield and visor originally intended for use by dentists to protect the dentist from exposure to blood and tooth detritus of infected patients. Essentially these prior art devices show a visor, a means for securing the visor to the head of the wearer, and a transparent shield which extends down from the outer edge of the visor and is positioned forward of the face of the wearer. The present invention differs from such prior constructions in that the means for retaining the visor on the head of the wearer is the conventional surgical cap to which the visor is secured.

SUMMARY OF THE INVENTION

A disposable surgeon's cap usually formed of nonwoven paper is so constructed that it is firmly attached to the head of the wearer. There are many styles of caps produced by many manufacturers. Essentially, the cap consists of a crown, sides below the crown, and ties on the bottom edges of the sides which tie around the head of the wearer. It will be understood that many different types of caps are usable in connection with the present invention.

The visor used in the present invention is sewn or otherwise attached to the bottom edge of the front of the cap. The visor may be made of many different types of materials, such as plastic, stiff paper, a material similar to foam rubber, hard plastics, or other suitable material. Various means may be used to attach the visor to the cap. A preferred way hereinafter described is to form tabs on the inner edge of the visor which project upwardly and are stitched to the cap by means of the stitching conventionally used to stitch a supporting tape to the bottom edge of the cap. It will be understood that the visor of the present invention projects forward and downward in a manner similar to the visor of a man's cap.

The shield of the present invention is transparent and extends from the bottom of the visor down to a position about the chin of the wearer and also extends around the sides of the face to protect the eyes, nose and mouth from exposure to blood, etc., which may be discharged from a patient during an operation and which may be contaminated. Various means may be employed to attach the shield to the visor. A preferred means is to form upward-extending projections on the upper edge of the shield which fit through slits formed near the outer edge of the visor. The projections snap through the slits and hold the visor in place.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
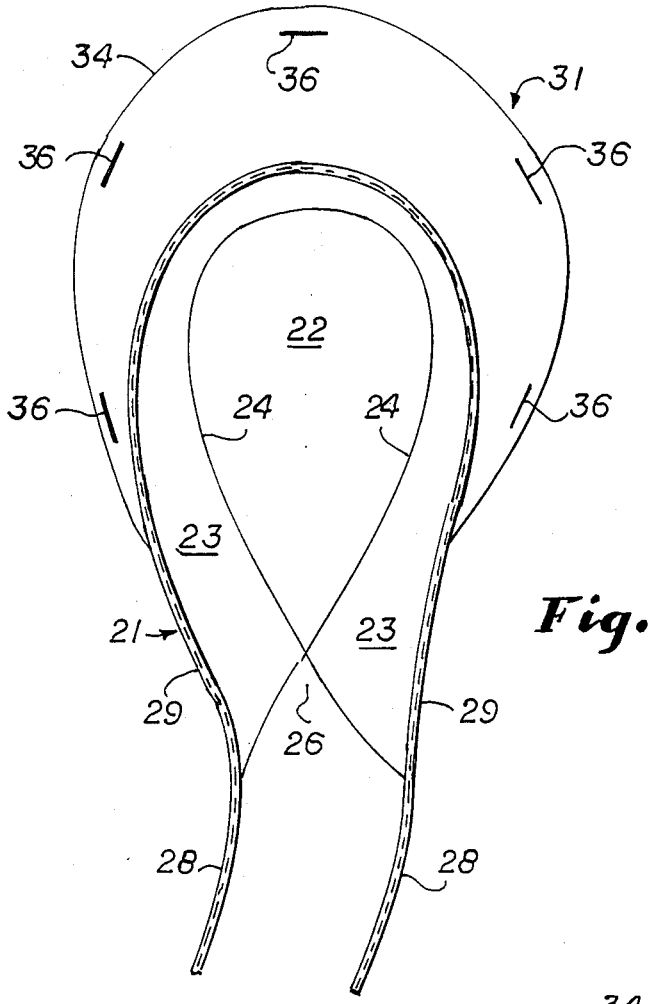
FIG. 1 is a plan view of a combined cap and mask prior to being tied on the head of the wearer.
Figure 2:
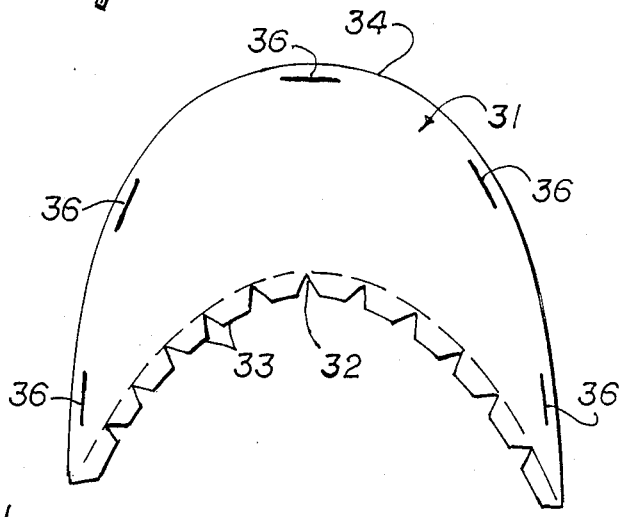
FIG. 2 is a plan view of a visor prior to assembly on a mask.
Figure 3:
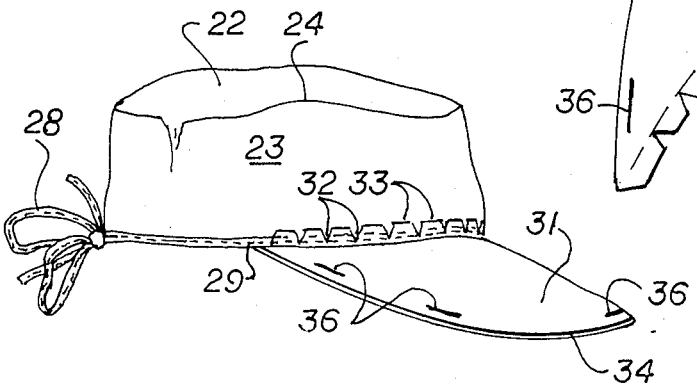
FIG. 3 is a perspective view showing the cap as tied on the head.

A conventional surgeon's cap 21 has a crown 22 and sides 23 around the outer edges of the crown. By sewing a seam 24 or by heat sealing or other means, the crown 22 is attached to the sides 23. As shown in the accompanying drawings, the crown 22 has a curved front and reverse curved inward converging side edges. Preferably, before the cap is tied onto the head of the wearer, there is an opening 26 at the back. A tape reinforcement 27 is sewn by stitching 29 to the bottom edge of sides 23 and extends rearward in strings 28 which are tied behind the head of the wearer and close the opening 26. It will be understood that a commercially available surgeon's cap has been described and it is contemplated that many other types of caps for similar purposes may be used with the present invention.

Visor 31 is made of any of the materials heretofore described or any suitable material. It functions like the bill of a man's cap. The inner edge 32 is formed with tabs 33 which may be bent upward and sewn to the cap 21 by the same stitching 29 which stitches the reinforcement 27 to the sides 23. Various other means may be used to attach the visor to the cap, such as stapling, heat sealing, gluing or other suitable means. Adjacent the outer edge 34 of the visor 31, but spaced inwardly thereof, there are slits 36 which are used to attach the shield 41 to the visor 31. It will be understood, however, that other means may be used for attaching the visor and shield which may not require the use of slits 36.

Shield 41 has a top edge 42 from which extend upward projections 43. In one preferred embodiment, the outer edges 44 are rounded and terminate in inward slanted sides 46. Thus, when the projections 43 are forced through the slits 36, by reason of the shape of the projections 43 they snap into position and are held in place against unintentional disassembly. A preferred shape of shield 41 has downward-inward converging sides 47 and a bottom 48 generally parallel to top edge 42. By reason of the fact that the visor 31 is curved, as shown in the accompanying drawings, the shield 41, when assembled thereto, likewise curves so that the edges 47 are positioned around the sides of the face and the bottom edge 48 is about at the level of the chin of the wearer.

An alternate shape of projections 46 is shown in visor 41*a*. The projections 43*a* have hooks 51 turned parallel to upper edge 42*a* and rounded corners 52 opposite the hooks 51. Such projections 43*a* are intended for use with non-resilient visors 31, whereas the shield 41 is intended for use with visors 31 formed of flexible foam material.

Figure 6:
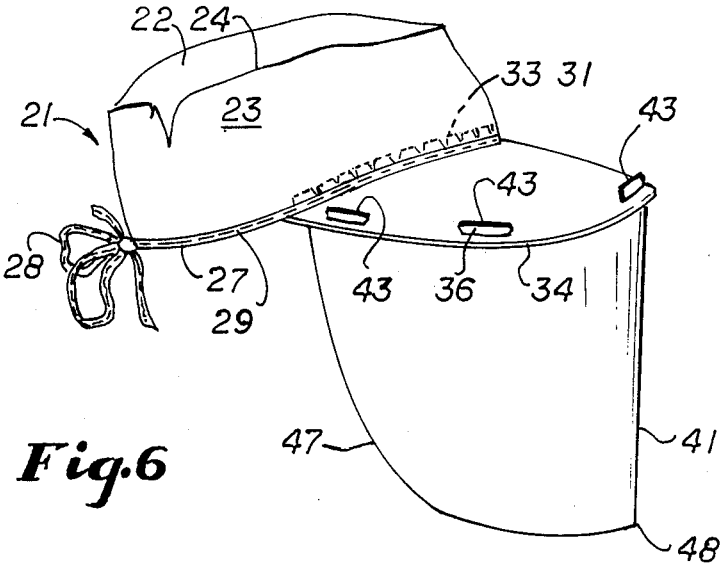
FIG. 6 is a perspective view of an assembled device.
Figure 4:
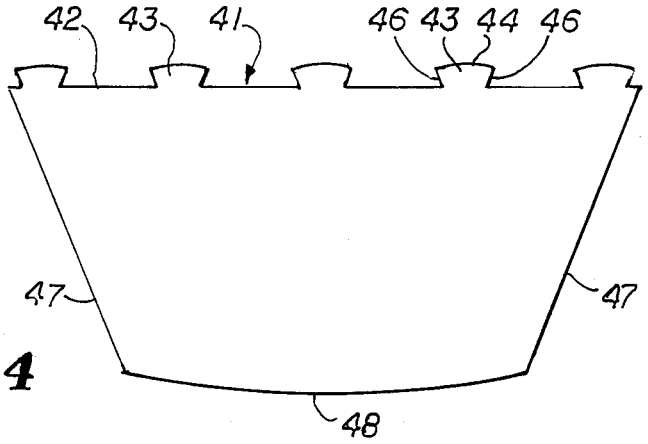
FIGS. 4 and 5 are plan views of shields which may be used with the device.
Figure 5:
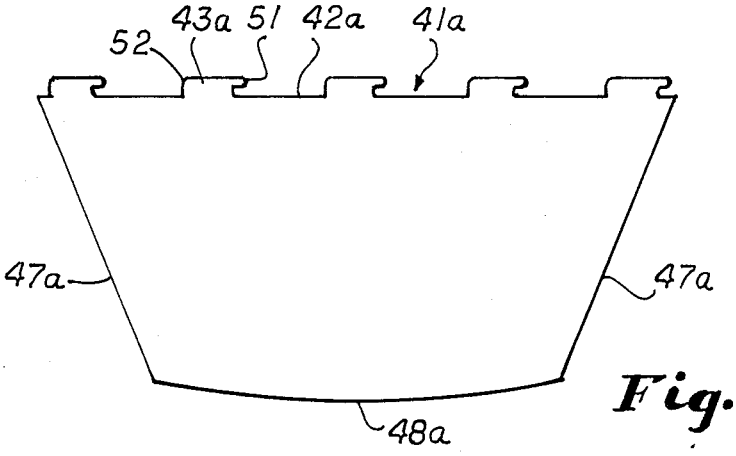

In use, the product is shipped with the visor 31 sewn to the cap 21. The shield 41 is usually provided with a covering to protect it against scratching during transportation and storage. The covering is peeled off by a scrub nurse or other operating room personnel and the projections 43 are forced through the slits 36. The device then has the position generally shown in FIG. 6. The cap 21 is placed over the head of the wearer and the ties 28 formed in a knot at the back of the head, thereby securing the cap 21 in place and likewise positioning the visor 31 in proper position so that the shield 41 extends down into proper position.

What is claimed is:

1. A protective device for surgeons and surgical personnel comprising a disposable surgeon's cap having head covering means terminating in a lower edge spacer means at about the level of said lower edge extending forwardly from the forehead of the wearer, first attachment means attaching said spacer means to said cap, a transparent shield having a length substantially greater than said spacer means sufficient to extend down to protect the eyes, nose and mouth of the wearer, second attachment means attaching said shield to said shield to said spacer means substantially at a right angle to said spacer means, said second attachment means comprising slits in said spacer means spaced apart along the outer edge of said spacer means, and projections on the upper edge of said shield fitting thru said slits.

2. A device according to claim 1 in which said cap is made of a paper-like substance and has a crown and sides around said crown.

3. A device according to claim 1 in which said cap is formed with a reinforcing binding along said lower edge, said binding extending rearward to form ties.

4. A device according to claim 3 in which said first attachment means comprises extensions on said spacer means and stitching stitching said binding to said lower edge and said extensions to said cap.

5. A device according to claim 4 in which said sides are initially open at the back; said ties being capable of being tied in a knot at the back of the head and pulling said sides together to close said opening.

6. A device according to claim 1 in which said spacer means comprises a visor of relatively stiff material.

7. A device according to claim 1 in which said spacer means is of a non-resilient material and said projections have hooks on one outer edge, whereby when said projections are pushed through said slits and said shield is twisted relative to said spacer means in the direction of said hooks, said shield is suspended from said visor.

8. A device according to claim 1 in which said spacer means is of a sponge-rubber-like material and said projections are wider at their outer ends than their inner ends, whereby said projections when forced through said slits stretch said slits which then return to original length to retain said shield suspended from said spacer means.

* * * * *